US009885472B2

(12) United States Patent
Horng et al.

(10) Patent No.: US 9,885,472 B2
(45) Date of Patent: Feb. 6, 2018

(54) ILLUMINATING VENTILATOR

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Duo-Nian Shan, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 15/238,765

(22) Filed: Aug. 17, 2016

(65) Prior Publication Data

US 2017/0074503 A1 Mar. 16, 2017

(30) Foreign Application Priority Data

Sep. 14, 2015 (TW) ..... 104130287 A

(51) Int. Cl.

| | |
|---|---|
| ***F21V 33/00*** | (2006.01) |
| ***F21V 23/02*** | (2006.01) |
| ***F21S 8/02*** | (2006.01) |
| ***F21V 23/06*** | (2006.01) |
| ***F21V 23/00*** | (2015.01) |
| ***F24F 13/078*** | (2006.01) |
| *F21Y 115/10* | (2016.01) |

(52) U.S. Cl.

CPC ..... *F21V 33/0096* (2013.01); *F21S 8/026* (2013.01); *F21V 23/001* (2013.01); *F21V 23/02* (2013.01); *F21V 23/06* (2013.01); *F24F 13/078* (2013.01); *F21Y 2115/10* (2016.08)

(58) Field of Classification Search

CPC ..... F21V 33/0096; F21V 23/02; F24F 13/078

See application file for complete search history.

(56) References Cited

U.S. PATENT DOCUMENTS

2015/0117034 A1* 4/2015 Horng ..... F24F 13/078 362/373

FOREIGN PATENT DOCUMENTS

| | | |
|---|---|---|
| TW | 581206 U | 3/2004 |
| TW | M316334 U | 8/2007 |

* cited by examiner

*Primary Examiner* — Donald Raleigh

(74) *Attorney, Agent, or Firm* — Alan D. Kamrath; Kamrath IP Lawfirm, P.A.

(57) ABSTRACT

An illuminating ventilator includes a case, a lamp and a power supply module. A first air opening and a second air opening are respectively formed on two sides of the case. The case includes an air channel having two ends respectively communicating with the first air opening and the second air opening. The fan is disposed in the case and is arranged in the air channel. The lamp is detachably attached to the case. The power supply module includes an AC input terminal, a first DC output terminal and a second DC output terminal. The first DC output terminal is electrically connected with the fan, and the second DC output terminal is electrically connected with the lamp. As such, the illuminating ventilator is provided with improved installation convenience, reduced production cost and reduced difficulty of maintaining and repairing.

19 Claims, 7 Drawing Sheets

ILLUMINATING VENTILATOR

CROSS REFERENCE TO RELATED APPLICATIONS

The application claims the benefit of Taiwan application serial No. 104130287, filed on Sep. 14, 2015, and the subject matter of which is incorporated herein by reference.

BACKGROUND OF THE INVENTION

1. Field of the Invention

The present invention generally relates to an illuminating ventilator and, more particularly, to an illuminating ventilator having a power supply module.

2. Description of the Related Art

Illuminating devices (e.g. recessed lamps) and ventilating devices (e.g. ventilators) are usually installed into a hollow opening in a ceiling to avoid affecting the appearance of an indoor space. Such an illuminating device and a ventilating device are disclosed in Taiwanese patents, such as Taiwan Patents No. 581206 and M316334, respectively.

However, before installing said recessed lamp or ventilator, a corresponding installation hole must be formed in the ceiling for the recessed lamp or ventilator to be installed therein. The formation of the installation hole adversely affects the appearance of the space where the recessed lamp or ventilator is arranged, and even makes the installation significantly complicated.

Hence, in order to bore holes as few as possible, the user tends to install an illuminating ventilator in the case that illumination and ventilation functions are both required. In this way, the illuminating ventilator provides illumination and ventilation functions at the same time, with only one installation hole required.

Nevertheless, a conventional illuminating ventilator has a ventilator and a lamp combined together to be installed in the installation hole in the ceiling. The ventilator has a power supply unit, and the lamp has another power supply unit. Therefore, the installer has to separately connect the power supply unit of the ventilator and the power supply unit of the lamp to an electrical power grid. Specifically, the connection process for settling each power supply unit includes complicated steps such as arranging wires, removing insulating layers of the wires, winding the wires together, rewrapping the wires with insulating materials (e.g. insulating tape), and packing the wires. Since such connection process must be done twice to separately connect the power supply units of the ventilator and the lamp to the electrical power grid, the installation of the conventional illuminating ventilator is inconvenient.

In another aspect, as would be appreciated by persons ordinarily skilled in the art, the power supply units of the ventilator and the lamp can be connected together in parallel in another type of conventional illuminating ventilator. As such, these two power supply units can be connected to a single power input. However, since the voltage and current for the ventilator are different from those for the lamp, appropriate insulating components and separating members are thus required to avoid the interference between the power supply units of the ventilator and the lamp, to further protect the ventilator and the lamp. According to the above, in this type of conventional illuminating ventilator, the power supply units of the ventilator and the lamp can be connected to the same power input, but the design thereof is rather complicated. Besides, such a conventional illuminating ventilator requires an additional insulating component and a separating member, thus resulting in a high production cost.

Furthermore, since the ventilator and the lamp are combined together, when a component of either the ventilator, the lamp or the power supply units needs to be repaired or inspected, the repairer must uninstall the entire illuminating ventilator for repairing or inspecting said component. Hence, it is hard to maintain and repair the conventional illuminating ventilator. In addition, with the inconvenience as described above in the installation of the conventional illuminating ventilator, the repairer has to face said inconvenience again when reinstalling the illuminating ventilator after the inspecting and repairing processes.

In light of the above, it is necessary to provide a modified illuminating ventilator for solving the problems of installation inconvenience, high production cost and repairing difficulty.

SUMMARY OF THE INVENTION

It is therefore the objective of this invention to provide an illuminating ventilator having a power supply module electrically connected to a fan and a lamp separately. As such, installation convenience of the illuminating ventilator is improved, and maintaining and repairing difficulties thereof are reduced.

The present disclosure provides an illuminating ventilator including a case, a lamp and a power supply module. A first air opening and a second air opening are respectively formed on two sides of the case. The case includes an air channel having two ends respectively communicating with the first air opening and the second air opening. The fan is disposed in the case and is arranged in the air channel. The lamp is detachably attached to the case. The power supply module includes an AC input terminal, a first DC output terminal and a second DC output terminal. The first DC output terminal is electrically connected with the fan, and the second DC output terminal is electrically connected with the lamp.

In the illuminating ventilator described above, the first DC output terminal is a constant voltage output.

In the illuminating ventilator described above, the lamp is a light-emitting diode lamp.

In the illuminating ventilator described above, the second DC output terminal is a constant current output.

In the illuminating ventilator described above, the fan has an axial direction. The power supply module is arranged between the case and the lamp in the axial direction, and the power supply module is detachably attached to the case or the lamp.

In the illuminating ventilator described above, the lamp includes a seat at a side facing the case, and the power supply module is detachably attached to the seat.

In the illuminating ventilator described above, the fan includes a base having a surface facing the lamp, and the power supply module is detachably attached to the surface of the base.

In the illuminating ventilator described above, the second air opening is arranged at a side of the case, with said side of the case facing the lamp in the axial direction. The power supply module is arranged between the second air opening and the lamp.

In the illuminating ventilator described above, the fan has an axial direction and a radial direction perpendicular to the axial direction, and the power supply module is arranged at a lateral side of the fan in the radial direction.

The illuminating ventilator described above further includes a socket extending in the axial direction. The socket is arranged at the case. The power supply module is detachably received in the socket, such that the power supply module is arranged at the lateral side of the fan.

In the illuminating ventilator described above, the second air opening is arranged at a side of the case, with said side of the case facing the lamp in the axial direction. The case forms an expansion portion around an outer periphery of the second air opening, such that an inner diameter of the second air opening is larger than an outer diameter of the fan, and such that the socket is arranged at the expansion portion.

In the illuminating ventilator described above, the socket aligns with the fan in the radial direction.

In the illuminating ventilator described above, the socket includes a through hole and a lid. The through hole is arranged at the expansion portion and faces the lamp in the axial direction, such that the power supply module is able to be inserted into the socket via the through hole. The lid is adapted for covering the through hole.

In the illuminating ventilator described above, the illuminating ventilator is adapted to be settled in an installation hole of a divider. The installation hole communicates two opposite surfaces of the divider. The case includes a penetrated hole extending from an inner surface to an outer surface thereof. The power supply module is able to be arranged out of the case and connected with the fan and the lamp through the penetrated hole. The power supply module can be arranged on one of the faces of the divider or arranged in other locations outside of the case.

With the arrangements described above, it merely requires connecting the AC input of the power supply module to an external power source which generates the electrical power required for the fan and the lamp. Thus, the installation of the illuminating ventilator is convenient, and the production cost is reduced. Furthermore, since the case needs not be uninstalled when inspecting and repairing the lamp or the power supply module, it is convenient to maintain or repair the illuminating ventilator.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
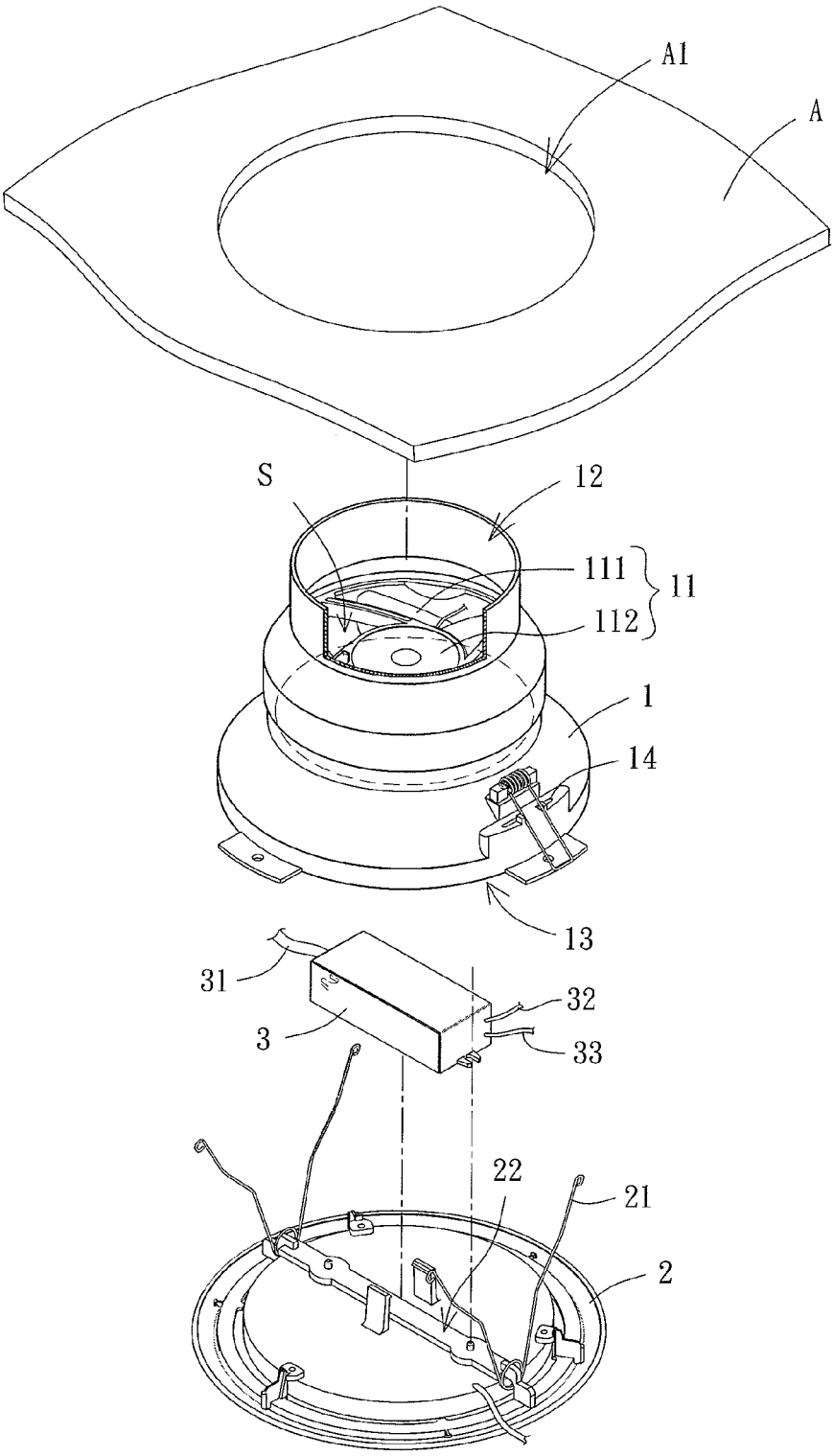
FIG. 1 is an exploded view of a first embodiment of the present disclosure.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
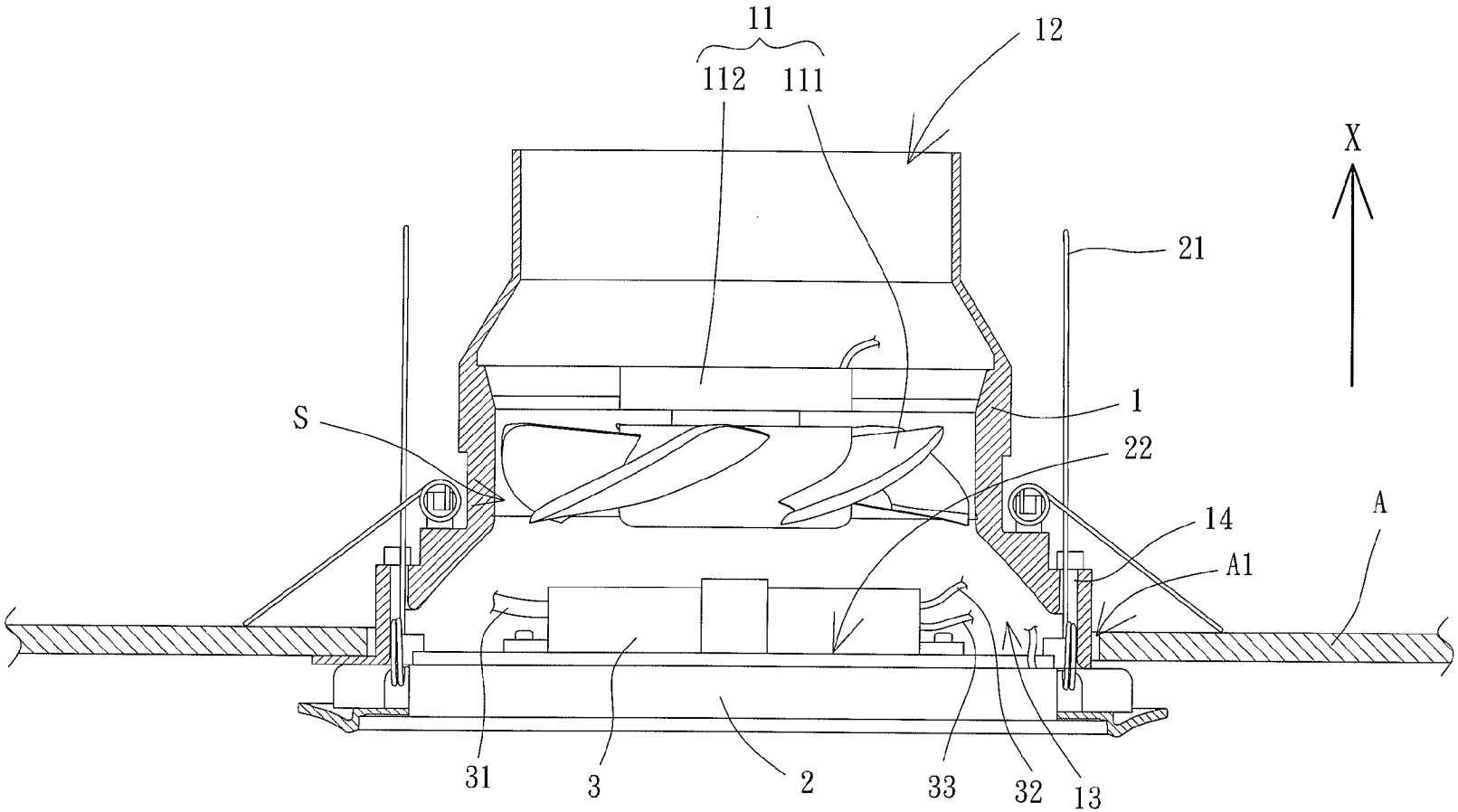
FIG. 2 is a cross sectional view of the first embodiment of the present disclosure.

Please refer to FIGS. 1 and 2, an illuminating ventilator according to a first embodiment of the present disclosure includes a case 1, a lamp 2 and a power supply module 3. The lamp 2 is detachably attached to the case 1. A fan 11 is disposed in the case 1. The power supply module 3 is electrically connected with the fan 11 and the lamp 2 separately.

In this embodiment, the fan 11 can be an axial flow fan. Alternatively, the fan 11 can be a blowing fan, which is not limited in the present disclosure. The fan 11 includes a fan wheel 111 and a base 112, and the fan wheel 111 can be coupled with the base 112. A first air opening 12 and a second air opening 13 are formed on two sides of the case 1, respectively. The case 1 includes an air channel S having two ends respectively communicating with the first and second air openings 12, 13, with the fan 11 received in the air channel S. Besides, the first and second air openings 12, 13 can communicate with an outlet and an inlet of the fan 11, respectively. The case 1 can be settled in an installation hole A1 of a divider A. The case 1 includes a first coupling portion 14. The fan 11 has an axial direction X parallel to the shaft (not shown) of the fan 11. The second air opening 13 can be arranged on a side of the case 1, with said side of the case 1 facing the lamp 2 in the axial direction X. The first coupling portion 14 can be arranged on the case 1 and adjacent to the second air opening 13. On the other hand, the base 112 of the fan 11 can have a surface facing the first air opening 12 in the axial direction X.

The lamp 2 includes a second coupling portion 21 adapted to be coupled with the first coupling portion 14 of the case 1. As such, the lamp 2 can be detachably attached to the case 1. Moreover, the second coupling portion 21 can be aligned with the first coupling portion 14 in the axial direction X. Besides, the first and second coupling portions 14 and 21 can respectively form an engaging hole and an engaging member, such that the lamp 2 can be coupled to the case 1, with the engaging member of the second coupling portion 21 engaged with the engaging hole of the first coupling portion 14. Instead of said engaging structures, the first and second coupling portions 14 and 21 can be, but not thus limited to, screwing structures, tenoning structures, or other structures that can be coupled together.

The power supply module 3 includes an AC input terminal 31, a first DC output terminal 32 and a second DC output terminal 33. The AC input terminal 31 is adapted to be electrically connected with an external power source (e.g. an electrical power grid) for receiving AC power. The first DC output terminal 32 is electrically connected with the fan 11, such that the fan 11 can be supplied with electrical power for rotation. The second DC output terminal 33 is electrically connected with the lamp 2, such that the lamp 2 can be supplied with electrical power for light generation.

Specifically, the fan 11 may include a DC motor. Said fan 11 usually uses a constant voltage power source as its input source, driving the DC motor to operate. Accordingly, the first DC output terminal 32 can be a constant voltage output for supplying the fan 11 with a constant voltage. The fan 11 and the first DC output terminal 32 can be electrically connected via conducting wires or a pair of connectors, such as a plug and a socket, an electrical contact (e.g. pins, terminal) and an electrical port.

On the other hand, the lamp 2 can be a light-emitting diode lamp. Said lamp 2 normally needs a constant current power source as its input source, driving the lamp to generate light. Accordingly, the second DC output terminal 33 can be a constant current output for supplying the lamp 2 with a constant current. Likewise, the lamp 2 and the second DC output terminal 33 can be electrically connected via conducting wires or a pair of connectors such as a plug and a socket, an electrical contact (e.g. pins, terminal) and an electrical port.

The power supply module 3 can include power related components, such as an AC/DC converter, for converting AC power received by the AC input terminal 31 into DC power. Besides, the power supply module 3 can further include a voltage transformer, frequency converter, voltage regulator or power semiconductor for converting said DC power into constant voltage or constant current power. Said constant voltage and constant current power are output from the first DC output terminal 32 and the second DC output terminal 33.

In this embodiment, the power supply module 3 is arranged between the case 1 and the lamp 2 in the axial direction X. Specifically, the power supply module 3 is arranged between the second air opening 13 and the lamp 2. As such, since the fan 11 draws air via the second air opening 13 as well as the power supply module is arranged between the second air opening 13 and the lamp 2, air current drawn by the fan 11 via the second air opening 13 can also cool the power supply module 3. Therefore, the above arrangement can apparently prolong the service life of the power supply module 3.

Among the above, the power supply module 3 can be detachably attached to the case 1 or the lamp 2. For example, as shown in FIGS. 1 and 2, the lamp 2 includes a seat 22 at a side facing the case 1 in the axial direction X. In this arrangement, the power supply module 3 can be detachably attached to the seat 22.

Figure 3:
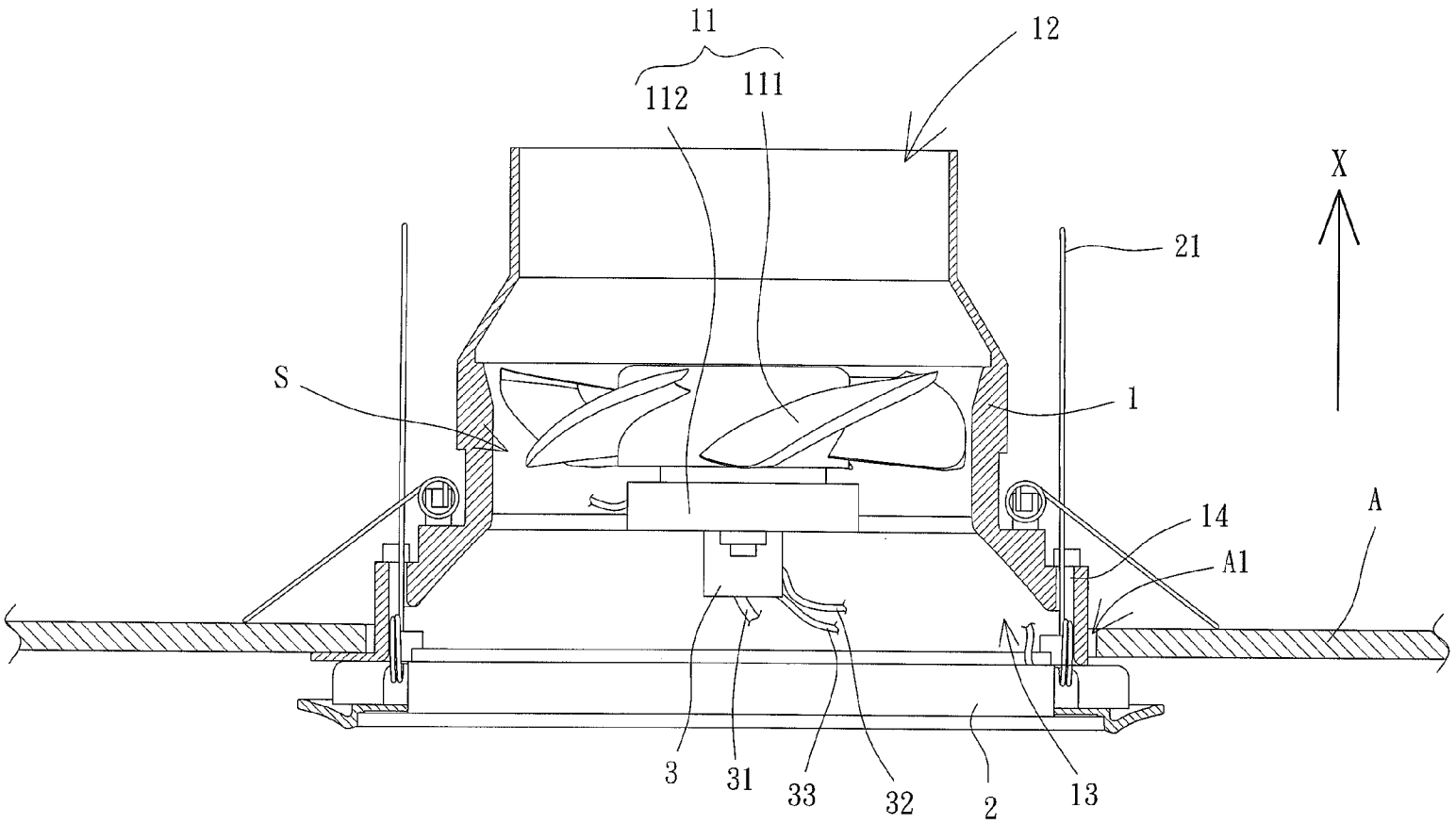
FIG. 3 is a cross sectional view of the first embodiment of the present disclosure, with a power supply module attached to a base of a fan thereof.

Alternatively, FIG. 3 shows another implementation of the first embodiment. In the illuminating ventilator of this implementation, the fan 11 also includes a base 112. However, the base 112 has a surface facing the lamp 2 (i.e. the second air opening 13) in the axial direction X, and the power supply module 3 can be detachably attached to said surface of the base 112.

According to the structure described above, when the illuminating ventilator according to the first embodiment of the present disclosure is in use, it can be installed in the installation hole A1 of the divider A. Specifically, the divider A can be a ceiling, wall or outer case of a system. The case 1 can be installed in the installation hole A1 of the divider A, such that the second air opening 13 can be aligned with the installation hole A1 in the axial direction X. The lamp 2 is detachably attached to the case 1 for shielding the installation hole A1. In this arrangement, the first DC output terminal 32 of the power supply module 3 can provide power to the fan 11 for rotation, such that the fan draws air via the second air opening 13 and discharges air via the first air opening 12, thus achieving a ventilation function. On the other hand, the second DC output terminal 33 of the power supply module 3 can provide power to the lamp 2, driving the lamp 2 to generate light, thus achieving an illumination function.

When installing the illuminating ventilator according to the first embodiment of the present disclosure, the user can settle the case 1 in the divider A by inserting the case 1 inside the installation hole A1 of the divider A. Next, the user can move the power supply module 3 to the second air opening 13 of the case 1. Hence, the electrical wire of the fan 11 can be connected to the first DC output terminal 32 of the power supply module 3, and the AC input terminal 31 of the power supply module 3 can be connected to an external electrical power source. Finally, the electrical wire of the lamp 2 can be connected to the second DC output terminal 33 of the power supply module 3, and, then, the lamp 2 can be attached to the case 1. Thus, installation of the illuminating ventilator according to the first embodiment is completed.

According to the above, the illuminating ventilator according to the first embodiment of the present disclosure merely requires connecting the AC input terminal 31 of the power supply module to the external electrical power source, to supply electrical power to the fan 11 and the lamp 2 at the same time. Since it is not needed to repeat the complicated steps for connecting the external electrical power source, the illuminating ventilator according to the first embodiment of the present disclosure is thus provided with improved installation convenience. Besides, since the power supply module 3 can provide electrical power to the fan 11 and the lamp 2 at the same time, it is apparent that any interference caused by individual power supply units of the fan 11 and the lamp 2 may not happen in the present disclosure. Hence, an insulating component and a separating member are not required for the fan 11 and the lamp 2 in the illuminating ventilator, thus reducing the production cost of the illuminating ventilator.

Furthermore, since the lamp 2 is detachably attached to the case 1, when inspecting and repairing processes of the lamp 2 are required, the user can simply remove the lamp 2 away from the case 1. In this way, the lamp 2 can be detached for inspecting, repairing or replacing purposes, and, then, a normally functioning lamp 2 can be attached to the case 1 as described above. Likewise, since the power supply module 3 are detachably attached to the case 1 or the lamp 2, when inspecting and repairing processes is required for the power supply module 3, the user can also remove the power supply module 3 away from the case 1 after removing the lamp 2. Thus, the power supply module 3 can be detached for inspecting, repairing or replacing purposes. Since the case 1 needs not be uninstalled from the divider A when inspecting and repairing the lamp 2 or the power supply module 3, it is convenient to maintain or repair such an illuminating ventilator.

Figure 4:
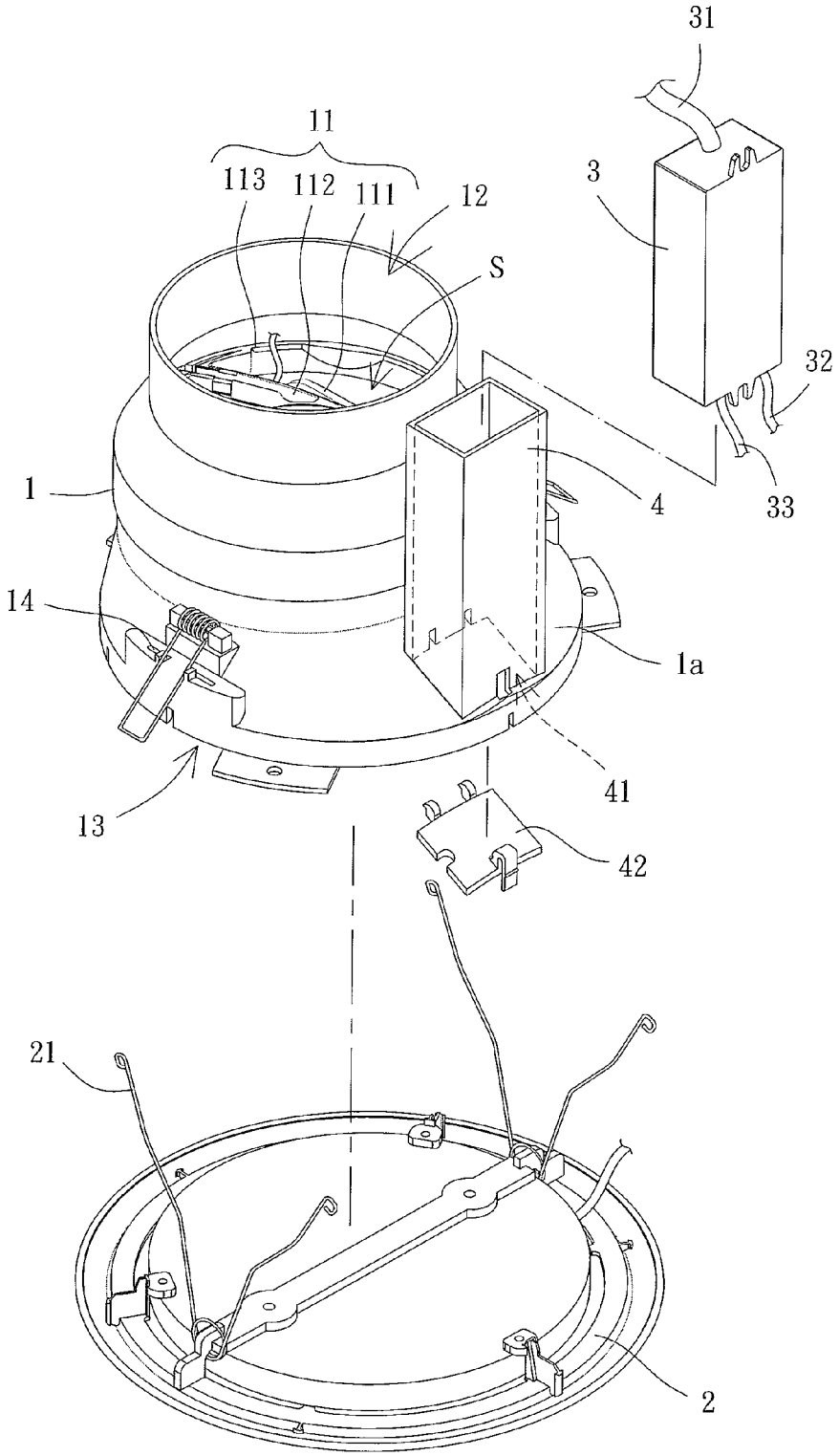
FIG. 4 is an exploded view of a second embodiment of the present disclosure.
Figure 5:
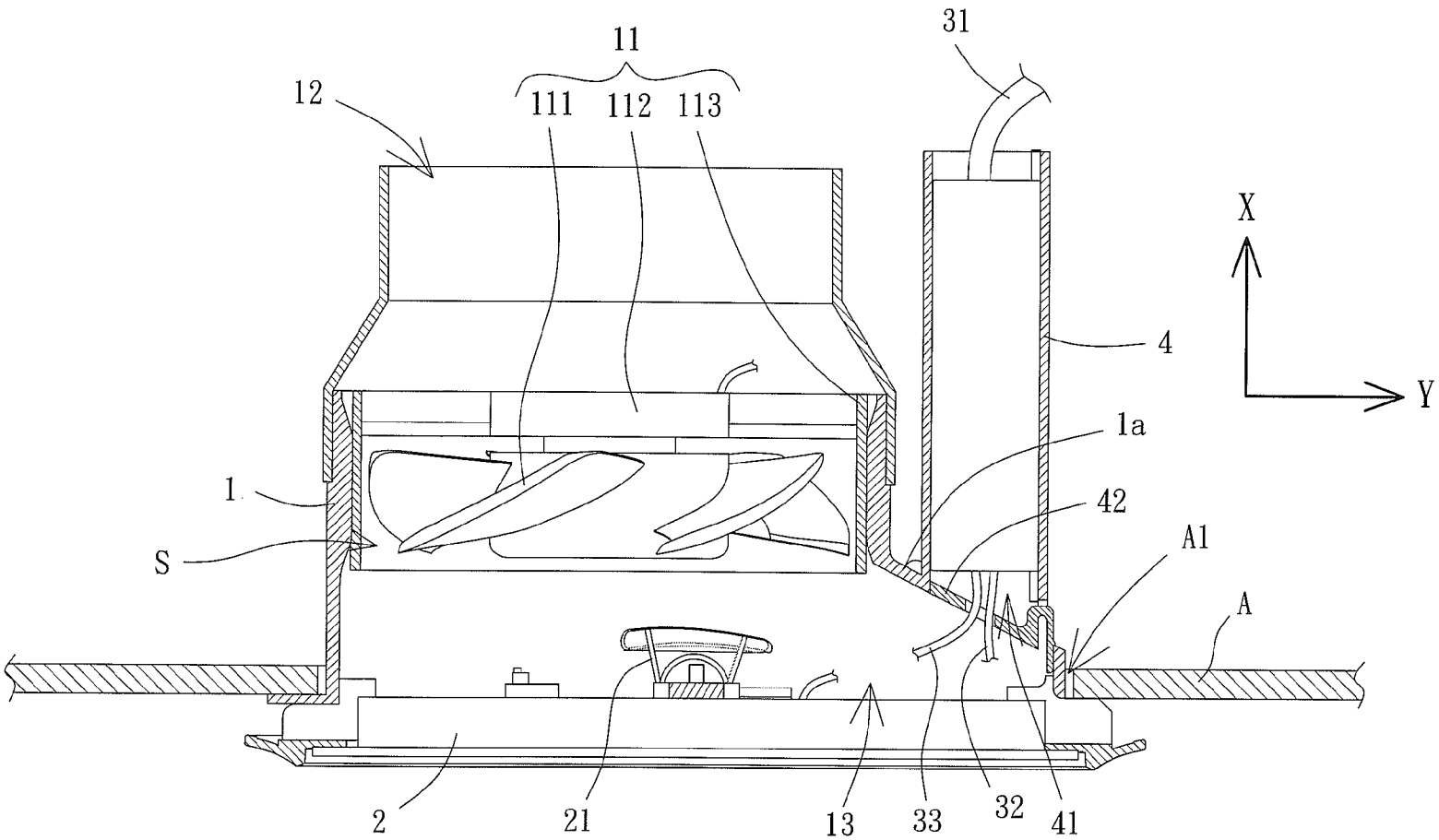
FIG. 5 is a cross sectional view of the second embodiment of the present disclosure.

Please refer to FIGS. 4 and 5, which shows an illuminating ventilator according to a second embodiment of the present disclosure. This embodiment differs from the first embodiment in that the fan 11 has a radial direction Y perpendicular to the axial direction X, and the power supply module 3 is arranged at a lateral side of the fan 11 in the radial direction Y. Specifically, the illuminating ventilator of this embodiment further includes a socket 4 arranged at the case 1, with the power supply module 3 detachably received in the socket 4.

The socket 4 can be coupled to the case 1. Alternatively, the socket 4 can be integrally formed at the case 1. Namely, the way to connect the socket 4 to the case 1 is not limited in the present disclosure. Specifically, the second air opening 13 of this embodiment is arranged at a side of the case 1, with said side facing the lamp 2 in the axial direction X. The case 1 forms an expansion portion 1*a* around an outer periphery of the second air opening 13, such that an inner diameter of the second air opening 13 is larger than an outer diameter of the fan 11. The socket 4 can be arranged at the expansion portion 1*a*. Since the socket 4 extends in the axial direction X, when the socket 4 is arranged at the expansion portion 1*a*, the socket 4 can align with the fan 11 in the radial direction Y for arranging the power supply module 3 at the lateral side of the fan 11 in the radial direction Y. The socket 4 can include a through hole 41 and a lid 42. The through hole 41 is arranged at the expansion portion 1*a* and facing the lamp 2 in the axial direction X, such that the power supply module 3 can be inserted into the socket 4 via the through hole 41. Namely, the through hole 41 is adapted for the power supply module 3 to be inserted therethrough into the socket 4. The lid 42 can cover the through hole 41, to prevent the power supply module 3 from being disengaged from the socket 4.

According to the above, comparing the first embodiment having the power supply module 3 arranged between the case 1 and the lamp 2 in the axial direction X, and since the illuminating ventilator of the second embodiment has the socket 4 for receiving the power supply module 3, the power supply module 3 can be arranged at the lateral side of the fan 11 in the radial direction Y. With this arrangement, an axial height of the entire illuminating ventilator of the second embodiment can be reduced, making the illuminating ventilator suitable for the situation with an arrangement space limited in the axial direction X.

In another aspect, comparing to the fan 11 of the first embodiment without a frame, i.e. the fan wheel 111 of the fan 11 faces directly to the inner surface of the case 1, the fan 11 of this embodiment can further include a frame 113 arranged around an outer periphery of the base 112, with the fan wheel 111 arranged in the frame 113.

Figure 6:
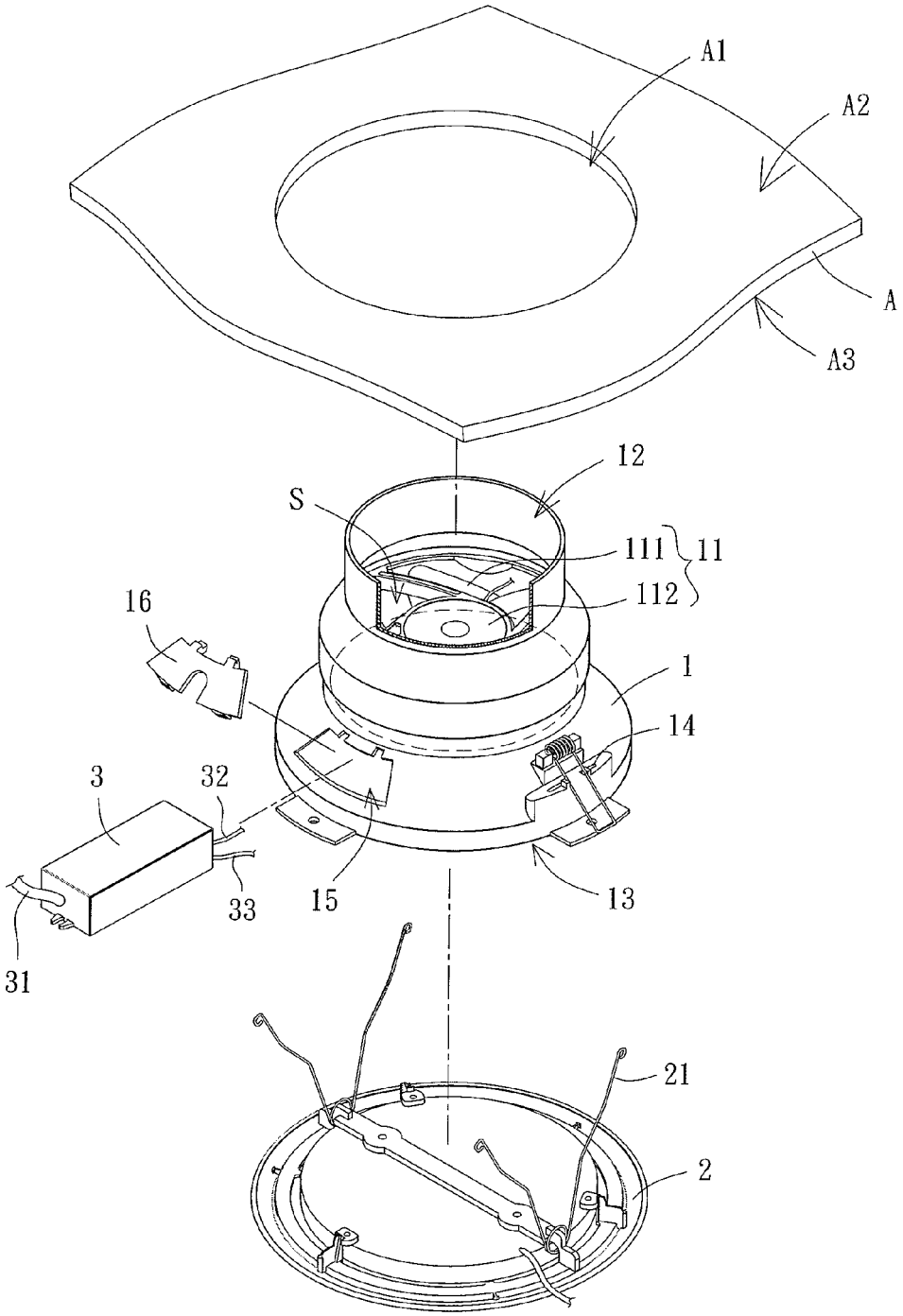
FIG. 6 is an exploded view of a third embodiment of the present disclosure.
Figure 7:
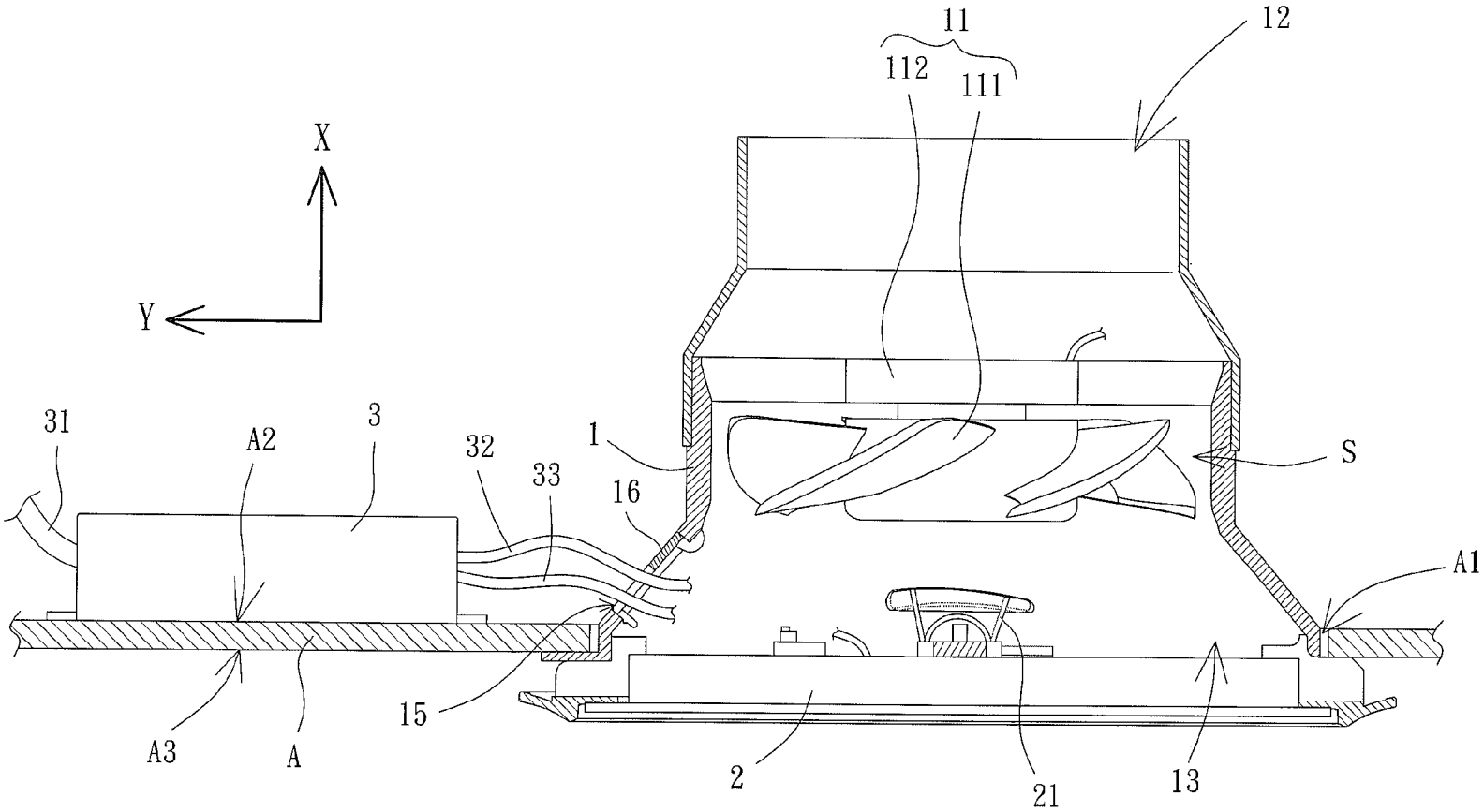
FIG. 7 is a cross sectional view of the third embodiment of the present disclosure.

Please refer to FIGS. 6 and 7. Similarly, an illuminating ventilator according to a third embodiment of the present disclosure also has the power supply module 3 arranged at the lateral side of the fan 11 in the radial direction Y. This embodiment differs from the above two embodiments in that the case 1 includes a penetrated hole 15 and a cover 16, while the installation hole A1 of the divider A communicates two opposite surfaces A2, A3 of the divider A. Particularly, the penetrated hole 15 communicates inner and outer surfaces of the case 1, such that the power supply module 3 can be arranged out of the case 1. Namely, the penetrated hole 15 is adapted for the power supply module 3 to be arranged out of the case 1. As such, the power supply module 3 can be arranged on the surface A2 of the divider A or at any location outside the case 1. The cover 16 covers the penetrated hole 15, to avoid the air current drawn by the fan 11 via the penetrated hole 15.

Specifically, when installing the illuminating ventilator of the third embodiment, the user can settle the case 1 in the divider A by inserting the case 1 in the installation hole A1 of the divider A. Next, the user can move the power supply module 3 to a location near the second air opening 13 of the case 1 for connecting the electrical wires of the fan 11 and the lamp 2 respectively to the first DC output terminal 32 and the second DC output terminal 33 of the power supply module 3, and for connecting the AC input terminal 31 of the power supply module 3 to the external power source. Finally, the user can move the power supply module 3 out of the case 1 via the penetrated hole 15 and can attach the power supply module 3 to the surface A2 of the divider A or can fix the power supply module 3 in any location outside the case 1. Then, the lamp 2 is coupled to the case 1 to complete the installation of the illuminating ventilator according to the third embodiment of the present disclosure.

Comparing the second embodiment having the socket 4 for receiving the power supply module 3, and since the third embodiment has the penetrated hole 15 arranged in the case 1, the power supply module 3 can be arranged at the surface A2 of the divider A or at any location outside the case 1. Furthermore, since the power supply module 3 is located outside the case 1, a radial width of the case 1 of the illuminating ventilator according to the third embodiment can be efficiently reduced. Hence, the illuminating ventilator of the third embodiment is suitable for the divider A with the installation hole A1 having a smaller inner diameter.

According to the above described structures, the embodiments of the present disclosure are characterized in the features discussed as follows.

With the arrangement of a power supply module 3 including an AC input terminal 31, a first DC output terminal 32 and a second DC output terminal 33, the illuminating ventilator of the present disclosure requires merely connecting the AC input terminal 31 to the external power source for providing the electrical power to the fan 11 and the lamp 2 respectively via the first DC output terminal 32 and the second DC output terminal 33, without the need of repeating the complicated steps for connecting the external power source. Comparing to the conventional illuminating ventilator which requires repeating twice the complicated steps for separately connecting the power supply unit of the ventilator and the power supply unit of the lamp 2 to the electrical power grid, the illuminating ventilator according to the embodiments of the present disclosure is apparently provided with convenient installation.

Besides, since the power supply module 3 can provide the electrical power to the fan 11 and the lamp 2 at the same time, it is apparent that any interference caused by individual power supply units of the fan 11 and the lamp 2 may not happen in the present disclosure. Hence, insulating components and separating members are not required for the fan 11 and the lamp 2, thus reducing the production cost of the illuminating ventilator.

Furthermore, since the lamp 2 is detachably attached to the case 1, when inspecting and repairing processes of the lamp 2 are required, the user can simply remove the lamp 2 away from the case 1. In this way, the lamp 2 can be detached for inspecting, repairing or replacing purposes, and a normally functioning lamp 2 can be attached to the case 1 as described above. Likewise, since the power supply module 3 is detachably attached to either one of the case 1, the lamp 2 and the socket 4, when inspecting and repairing processes are required for the power supply module 3, the user can also remove the power supply module 3 away from the case 1 after removing the lamp 2. Thus, the power supply module 3 can be detached for inspecting, repairing or replacing purposes. With comparison to the conventional illuminating ventilator which requires uninstalling the entire illuminating ventilator for repairing or inspecting the power supply unit of the ventilator, the lamp, or the power supply unit of the lamp, and since the case 1 of the illuminating ventilator of the present disclosure is not required to be uninstalled from the divider A when inspecting and repairing the lamp 2 or the power supply module 3, it is convenient to maintain or repair the illuminating ventilator of the present disclosure.

In summary, the illuminating ventilator according to the embodiments of the present disclosure is certainly provided with improved installation convenience, reduced production cost and reduced repairing difficulty.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An illuminating ventilator comprising:

a case with a first air opening and a second air opening respectively formed on two sides thereof, wherein the case comprises an air channel having two ends respectively communicating with the first air opening and the second air opening;

a fan disposed in the case, wherein the fan is arranged in the air channel;

a lamp detachably attached to the case; and a power supply module comprising an AC input terminal, a first DC output terminal and a second DC output terminal, wherein the first DC output terminal is electrically connected with the fan, wherein the second DC output terminal is electrically connected with the lamp, wherein the fan has an axial direction, wherein the power supply module is arranged between the case and the lamp in the axial direction, and wherein the power supply module is detachably attached to the case or the lamp.

2. The illuminating ventilator as claimed in claim 1, wherein the first DC output terminal is a constant voltage output.

3. The illuminating ventilator as claimed in claim 1, wherein the lamp is a light-emitting diode lamp.

4. The illuminating ventilator as claimed in claim 3, wherein the second DC output terminal is a constant current output.

5. The illuminating ventilator as claimed in claim 1, wherein, the lamp comprises a seat at a side facing the case, and wherein the power supply module is detachably attached to the seat.

6. The illuminating ventilator as claimed in claim 1, wherein the fan comprises a base having a surface facing the lamp, and wherein the power supply module is detachably attached to the surface of the base.

7. The illuminating ventilator as claimed in claim 1, wherein the second air opening is arranged at a side of the case, wherein said side of the case faces the lamp in the axial direction, and wherein the power supply module is arranged between the second air opening and the lamp.

8. The illuminating ventilator as claimed in claim 1, wherein the fan has a radial direction perpendicular to the axial direction, and wherein the power supply module is arranged at a lateral side of the fan in the radial direction.

9. The illuminating ventilator as claimed in claim 8, wherein the illuminating ventilator is adapted to be settled in an installation hole of a divider, wherein the installation hole communicates two opposite surfaces of the divider, wherein the case comprises a penetrated hole communicating an inner surface and an outer surface of the case, and wherein the power supply module is arranged out of the case.

10. The illuminating ventilator as claimed in claim 8, further comprising a socket extending in the axial direction, wherein the socket is arranged at the case, wherein the power supply module is detachably received in the socket, wherein the power supply module is arranged at the lateral side of the fan in the radial direction.

11. The illuminating ventilator as claimed in claim 10, wherein the second air opening is arranged at a side of the case, wherein said side of the case faces the lamp in the axial direction, wherein the case forms an expansion portion around an outer periphery of the second air opening, wherein an inner diameter of the second air opening is larger than an outer diameter of the fan, and wherein the socket is arranged at the expansion portion.

12. The illuminating ventilator as claimed in claim 11, wherein the socket aligns with the fan in the radial direction.

13. An illuminating ventilator comprising:

a case with a first air opening and a second air opening respectively formed on two sides thereof, wherein the case comprises an air channel having two ends respectively communicating with the first air opening and the second air opening;

a fan disposed in the case and having an axial direction and a radial direction perpendicular to the axial direction, wherein the fan is arranged in the air channel;

a lamp detachably attached to the case;

a power supply module comprising an AC input terminal, a first DC output terminal and a second DC output terminal, wherein the first DC output terminal is electrically connected with the fan, wherein the second DC output terminal is electrically connected with the lamp, and wherein the power supply module is arranged at a lateral side of the fan in the radial direction; and a socket extending in the axial direction, wherein the socket is arranged at the case, wherein the power supply module is detachably received in the socket, wherein the power supply module is arranged at the lateral side of the fan in the radial direction, wherein the second air opening is arranged at a side of the case, wherein said side of the case faces the lamp in the axial direction, wherein the case forms an expansion portion around an outer periphery of the second air opening, wherein an inner diameter of the second air opening is larger than an outer diameter of the fan, wherein the socket is arranged at the expansion portion, wherein the socket comprises a through hole and a lid, wherein the through hole is arranged at the expansion portion and faces the lamp in the axial direction, wherein the power supply module is inserted into the socket via the through hole, and wherein the lid covers the through hole.

14. The illuminating ventilator as claimed in claim 13, wherein the first DC output terminal is a constant voltage output.

15. The illuminating ventilator as claimed in claim 13, wherein the lamp is a light-emitting diode lamp.

16. The illuminating ventilator as claimed in claim 13, wherein the second DC output terminal is a constant current output.

17. The illuminating ventilator as claimed in claim 13, wherein the power supply module is arranged between the case and the lamp in the axial direction, and wherein the power supply module is detachably attached to the case or the lamp.

18. The illuminating ventilator as claimed in claim 13, wherein the socket aligns with the fan in the radial direction.

19. The illuminating ventilator as claimed in claim 13, wherein the illuminating ventilator is adapted to be settled in an installation hole of a divider, wherein the installation hole communicates two opposite surfaces of the divider, wherein the case comprises a penetrated hole communicating an inner surface and an outer surface of the case, and wherein the power supply module is arranged out of the case.

* * * * *